US005780109A

United States Patent [19]

Yapel et al.

[11] Patent Number: 5,780,109

[45] Date of Patent: Jul. 14, 1998

[54] DIE EDGE CLEANING SYSTEM

[75] Inventors: Robert A. Yapel, Oakdale; Thomas M. Milbourn, Mahtomedi; Aparna V. Bhave, Woodbury; Lawrence B. Wallace, Newport; Daniel V. Norton, Saint Paul; Hans E. Iverson, Ham Lake, all of Minn.

[73] Assignee: Minnesota Mining and Manufacturing Company, St. Paul, Minn.

[21] Appl. No.: 784,629

[22] Filed: Jan. 21, 1997

[51] Int. Cl.[6] ..... B05D 3/00

[52] U.S. Cl. ..... 427/294; 427/356; 427/402; 427/420

[58] Field of Search ..... 118/410, 411; 427/402, 420, 356, 294

[56] References Cited

U.S. PATENT DOCUMENTS

| | | | |
|---|---|---|---|
| 2,681,294 | 6/1954 | Beguin . | |
| 2,761,419 | 9/1956 | Mercier et al. . | |
| 3,289,632 | 12/1966 | Barstow . | |
| 3,690,917 | 9/1972 | Hershoff et al. . | |
| 3,735,729 | 5/1973 | Bird . | |
| 4,001,024 | 1/1977 | Dittman et al. . | |
| 4,113,903 | 9/1978 | Choinski . | |
| 4,287,240 | 9/1981 | O'Connor . | |
| 4,292,349 | 9/1981 | Ishiwata et al. . | |
| 4,313,980 | 2/1982 | Willemsens . | |
| 4,335,672 | 6/1982 | Krussig . | |
| 4,416,214 | 11/1983 | Tanaka et al. . | |
| 4,490,418 | 12/1984 | Yoshida | 118/411 |
| 4,525,392 | 6/1985 | Ishizaki et al. . | |
| 4,545,321 | 10/1985 | Bassa . | |
| 4,569,863 | 2/1986 | Koepke et al. . | |
| 4,572,849 | 2/1986 | Koepke et al. . | |
| 4,623,501 | 11/1986 | Ishizaki . | |
| 4,828,779 | 5/1989 | Hiraki et al. . | |
| 4,863,765 | 9/1989 | Ishizuka . | |
| 4,976,999 | 12/1990 | Ishizuka . | |
| 4,977,852 | 12/1990 | Ishizuka . | |
| 5,380,365 | 1/1995 | Hirshburg . | |
| 5,382,504 | 1/1995 | Shor et al. . | |
| 5,389,150 | 2/1995 | Baum et al. . | |
| 5,434,043 | 7/1995 | Zou et al. . | |
| 5,439,708 | 8/1995 | Tsujimoto et al. . | |
| 5,593,734 | 1/1997 | Yuan et al. . | |
| 5,624,715 | 4/1997 | Gueggi et al. | 427/420 |

FOREIGN PATENT DOCUMENTS

| | | | |
|---|---|---|---|
| 0552653 | 7/1993 | European Pat. Off. . | |
| 0622667 | 11/1994 | European Pat. Off. . | |
| 0627661 | 12/1994 | European Pat. Off. . | |
| 895535 | 1/1982 | U.S.S.R. | 118/411 |

OTHER PUBLICATIONS

Gutoff, "Simplified Design of Coating Die Intervals," *Journal of Imaging Science and Technology*, 1993, 37(6), 615–627.

E. D. Cohen and E. B. Gutoff, *Modern Coating and Drying Technology*, VCH Publishers (1992) pp. 9, 119–120, 143–145, 156–159, 162–163.

*Primary Examiner*—Katherine A. Bareford

*Attorney, Agent, or Firm*—William K. Weimer

[57] ABSTRACT

A method and apparatus for coating a moving web with a coating fluid. The coating die has at least one feed slot for supplying the coating fluid to the moving web and a front face demarked from the at least one feed slot by a die edge. A guide mechanism guides the moving web in a first direction past the coating die such that a coating bead is formed in a gap between the moving web and the die edge. The spraying system sprays a cleaning fluid on at least a portion of the front face of the slide coating die such that the coating bead forms a substantially linear static wetting line on the front face of the coating die.

12 Claims, 5 Drawing Sheets

DIE EDGE CLEANING SYSTEM

FIELD OF THE INVENTION

The present invention relates to a method and apparatus for coating liquids containing volatile solvents, and in particular, to a spraying system and method for maintaining a uniform wetting line of the coating bead.

BACKGROUND OF THE INVENTION

The production of high quality articles, particularly photographic, photothermographic, and thermographic articles, consists of applying a thin film of a coating solution on to a continuously moving substrate or web. Thin films can be applied using a variety of techniques including: dip coating, forward and reverse roll coating, wire wound rod coating, blade coating, slot coating, slide coating, and curtain coating. Coatings can be applied as a single layer or as two or more superimposed layers. Although it is usually most convenient for the substrate to be in the form of a continuous web, it may also be formed of a succession of discreet sheets.

Slide coaters have been used extensively since the 1950's in the photographic and related industries for coating aqueous photographic emulsions with relatively low viscosity (less than 100 cP). In slide coating, it is well known to start and stop coating of a moving web by means known as "pick-up." In the pick-up phase, the flow of the coating liquid is established with the coater die retracted from the web. The coating liquid drains over the die edge into a vacuum box and drain. Once the flows of all the coating liquids are stabilized from all the feed slots of the slide coating die, the die and vacuum box are moved into the coating position in a rapid manner with the web moving at the desired coating speed. When the die is in close proximity to the moving web, the coating liquid forms a coating bead that coats the web rather than draining over the die edge. If the coating process needs to be interrupted (for example, as a web splice is passing in the slide coating die), the die and vacuum box assembly are simply retracted from the web until resumption of the coating is desired.

Streak-type defects can be formed by disturbances of the coating bead. Mechanical disturbances include nicks in the die edge. Contamination disturbances that may cause streaking include dirt particles lodged near the coating bead, dried or semi-dried particles of coating compound, and non-uniform wetting of the contact line of the coating liquid on the coating die edge. Non-uniform wetting on the die edge, especially after pick-up, appears to be an important factor when coating fluids containing volatile solvents. For example, contamination may adhere to the front face and/or die edge of the slide coating die. That contamination may lead to a non-uniform wetting line and possible streaking of the coating compound.

FIG. 1 illustrates an exemplary slide coating die 20 in which a coating fluid 22 is flowing along a slide surface 24 to a die edge 26. A static wetting line 28 is formed along a front face 30 of the slide coating die 20. The irregular shape of the static wetting line 28 is likely to cause unevenness and streaking of the coating fluid as it is applied to the moving web (not shown).

Another problem related to slide coating is contamination of vacuum ports and drains in the vacuum box when the die is retracted from the moving web and the coating liquid is flowing freely. Contamination of the vacuum ports and drains can lead to unstable vacuum operation causing defects and eventually requiring cessation of the coating operation to clean the vacuum box and ports. This problem is exacerbated with high viscosity fluids (100–10,000 cP) that contain volatile solvents that dry much faster than water (such as methyl ethyl ketone, tetrahydrofuran, or methanol).

SUMMARY OF THE INVENTION

The present invention relates to a method and apparatus for coating a moving web with a coating fluid. The present invention is also directed to a spraying system for spraying the die edge region of a coating die with a cleaning fluid for a short duration subsequent to pick-up of the coating fluid onto the moving web.

The present spraying system cleans the front face of the coating die below the die edge so that a uniform wetting line of the coating bead is established. Additionally, a continuous low flow of cleaning fluid from the spray system may be maintained to keep the vacuum box, vacuum ports and drain tubes clean during the coating process. The spray system may be an arrangement of holes, slots, atomizers, spray nozzles, and a variety of other configurations.

The coating apparatus includes a coating die having at least one feed slot for extruding the coating fluid onto the moving web. The feed slot is demarked from a front surface of the die by a die edge. A guide mechanism guides the moving web in a first direction past the coating die such that a coating bead is formed in a coating gap between the moving web and the die edge.

A spraying system sprays a cleaning fluid at a first flow rate on at least a portion of the front face of the coating die. The first flow rate may generate an atomizing spray or a continuous stream of cleaning fluid. The spraying system includes a plurality of cleaning fluid ejection means arranged parallel to the width of the moving web and below the die edge. The spraying system preferably directs the cleaning fluid to a portion of the front surface about 1 to 20 mm below the die edge, but does not contact the moving web. The spraying system may also spray cleaning fluid at a second flow rate less then the first flow rate. In an alternate embodiment, a first cleaning fluid is sprayed at the first flow rate and a second cleaning fluid is sprayed at the second flow rate.

In one embodiment of the present invention, at least a portion of the coating bead is formed on the front face of the slide coating die. The coating bead has a substantially linear static wetting line on the coating die generally perpendicular to the first direction of the moving web. The wetting line is generally located on the front face.

The cleaning fluid is preferably a solvent of the coating fluid, such as methyl ethyl ketone, tetrahydrofuran, and methanol. It is understood that for aqueous coating fluids, the cleaning fluid may simply be water. The cleaning fluid serves a variety of purposes, such as for example pre-wetting critical surfaces of the coating system, preventing premature drying of the coating fluid, providing a vapor pressure to retard drying of the coating fluid, washing-off surfaces of the coating die to remove debris, and cleaning the vacuum box and vacuum ports.

The present spraying system may be used with a variety of die configurations, including a slide coating die, extrusion or slot coating die, or curtain coating die. For slide coating dies, the coating gap is between 0.0254 mm and 3.81 mm.

The present coating apparatus may also include a vacuum system for generating a reduced pressure condition below the coating bead and between the front face and the moving web. The vacuum system includes a drain chamber separated from a vacuum source by a partition. In another aspect of the present invention, the vacuum source and sensor ports are physically separated from possible contact with the coating fluid so as to prevent contamination.

The method of the present invention includes extruding the coating fluid through the feed slot(s) on a coating die. The coating die has a front face demarked from the feed slot by a die edge. The moving web and the coating die are positioned such that a coating bead is formed in a coating gap between the moving web and the die edge. Cleaning fluid is sprayed at a first flow rate on at least a portion of the front face of the coating die. Cleaning fluid is sprayed at a second flow rate such that the coating bead is not disturbed and a generally linear static wetting line is formed on the front face. The second flow rate is generally less than the first flow rate. The method of the present invention may also include generating a reduced pressure condition below the coating bead and between the front face and the moving web.

In one embodiment, the second flow rate is zero. The step of spraying a cleaning fluid optionally includes spraying a solvent of the coating fluid. A first fluid may be sprayed at the first flow rate and a second fluid sprayed at the second flow rate.

DETAILED DESCRIPTION OF THE PREFERRED EMBODIMENTS

Figure 2:
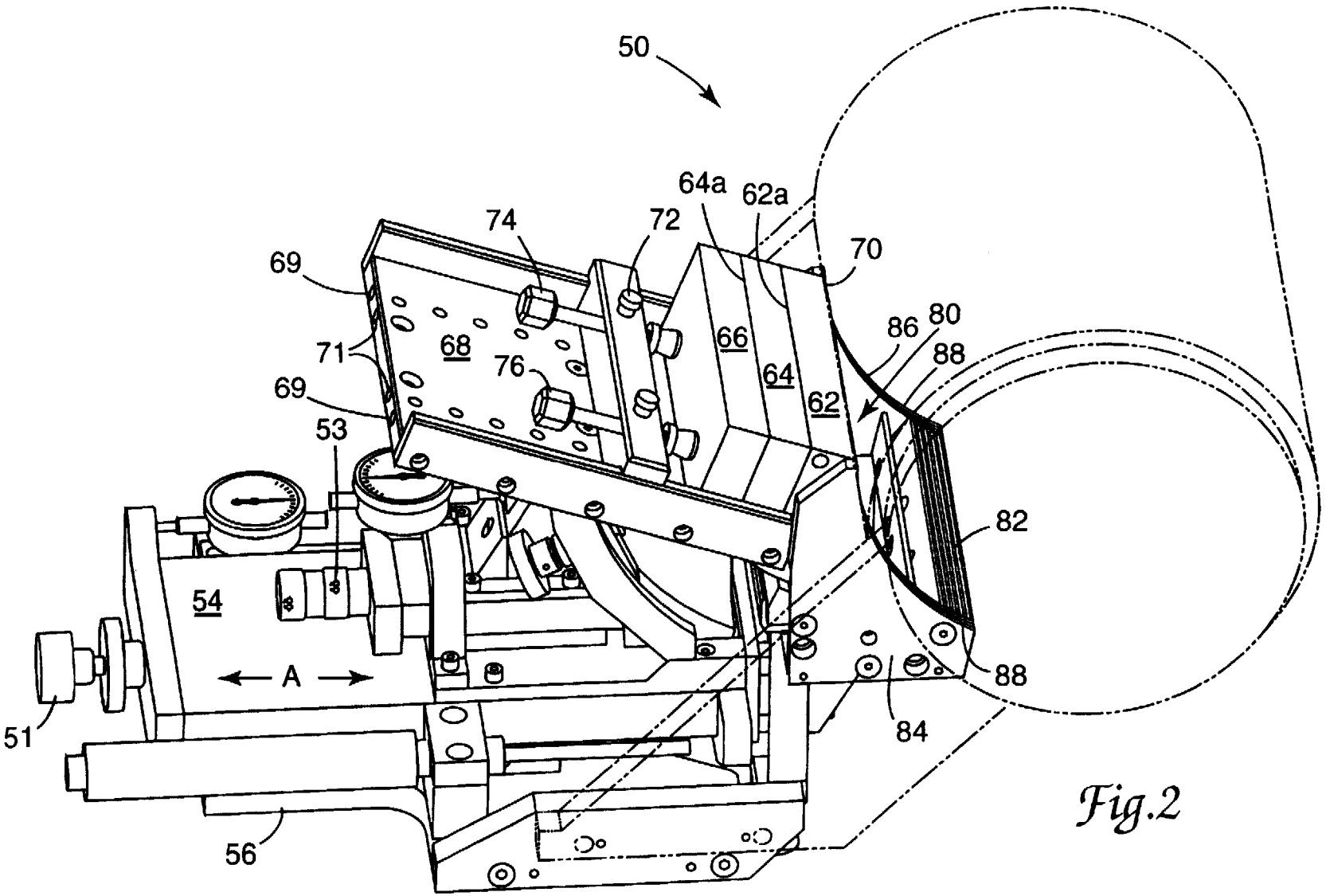
FIG. 2 is a perspective view of a slide coater assembly.
Figure 3:
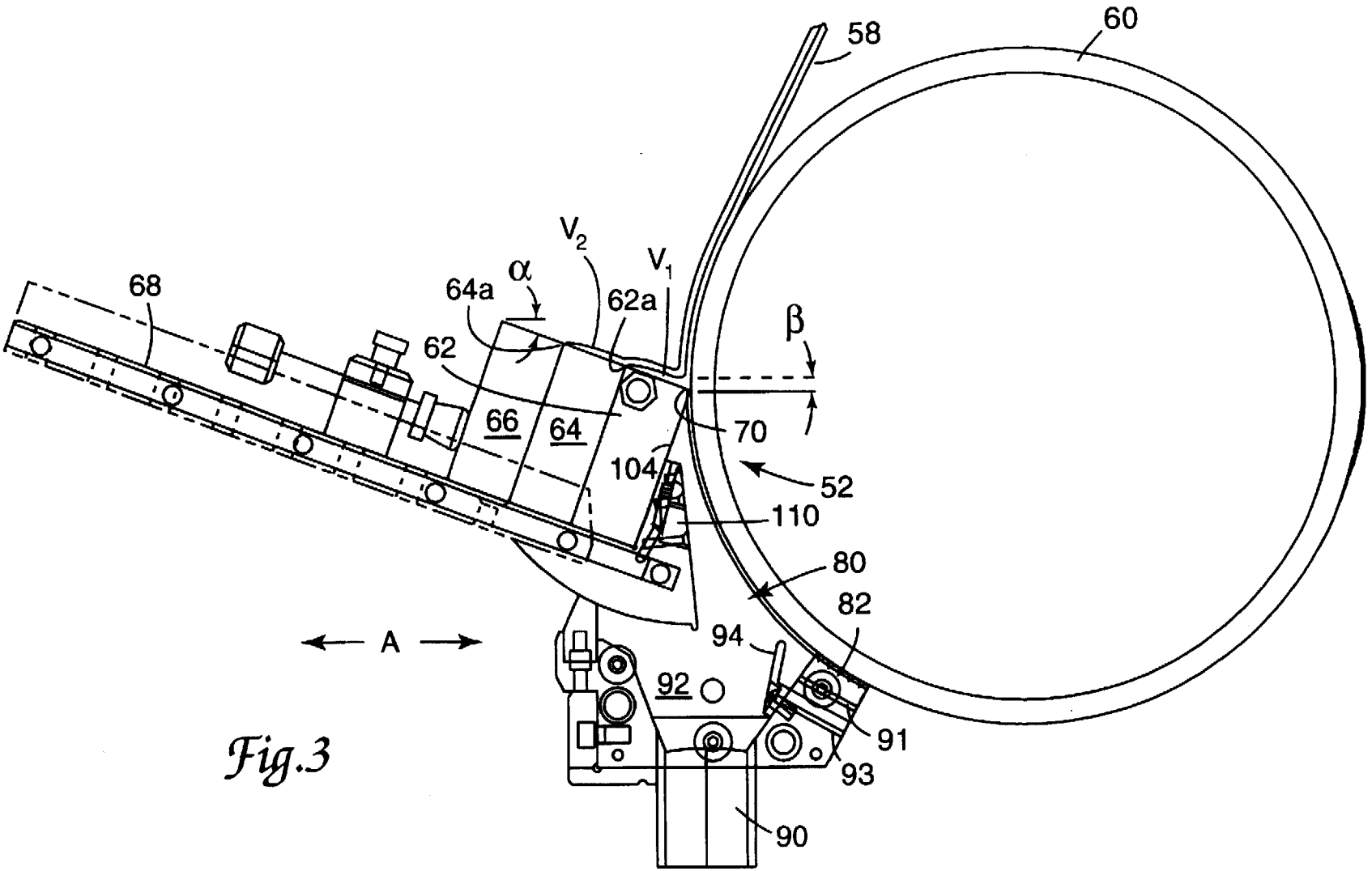
FIG. 3 is a side view of the slide coating assembly of FIG. 2.

FIGS. 2 and 3 illustrate a slide coater assembly 50 for use with the present die edge cleaning system 52 (see FIG. 3). Pneumatic slide 54 traverses a slide mounting bracket 56 along an axis A, between a retracted position and an engaged position near a moving web 58. The moving web 58 is guided by a supporting roll 60. Adjustment knobs 51, 53 are provided for fine tuning the location of the slide 54 relative to the web 58.

A series of slide coating bars, 64, 66 are positioned on a coating tray 68 in a downward sloping configuration at an angle $\alpha$. One or more coating fluids $V_1$ and $V_2$ are extruded through feed slots 62A and 64A and are permitted to flow under the force of gravity towards a die edge 70. A locking bar 72 with a pair of locking screws 74, 76 is provided on the coating tray 68 for retaining the coating bar 62, 64, 66 in the desired configuration. A method of coating a plurality of layers onto a substrate is disclosed in commonly assigned U.S. patent application entitled Method Of Coating a Plurality of Layers Onto a Substrate, U.S. patent application Ser. No. 08/784,669, filed on the same date herewith.

The die edge 70 is located immediately above a vacuum box 80. The vacuum box 80 preferably has a front seal 82 which engages with the web 58 with a small coating gap. A pair of side plates 84, 86 are located along the edge of the vacuum box 80 to complete the enclosure. The side plates 84, 86 preferably have a radius that corresponds to the radius of the supporting roll 60. Slots 88 may be formed in the edge of the side plates 84, 86 that engage with the supporting roll 60 so as to enhance the sealing capabilities thereof. A drain 90 is located at the bottom of the vacuum box 80 so that excess coating fluid collected in drain chamber 92 can be effectively disposed of. A solution guard 94 is located in the vacuum box 80 proximate the drain chamber 92 for protecting vacuum port 96 and vacuum sensing port 98 from contamination. Additional disclosure relating to a slide coater assembly is set forth in commonly assigned U.S. patent application Nos. 08/177,288 entitled Coater Die Enclosure System filed Jan. 4, 1994 and 08/641,407 entitled Coater Enclosure and Coating Assembly Including Coater Enclosure filed May 1, 1996.

Figure 5:
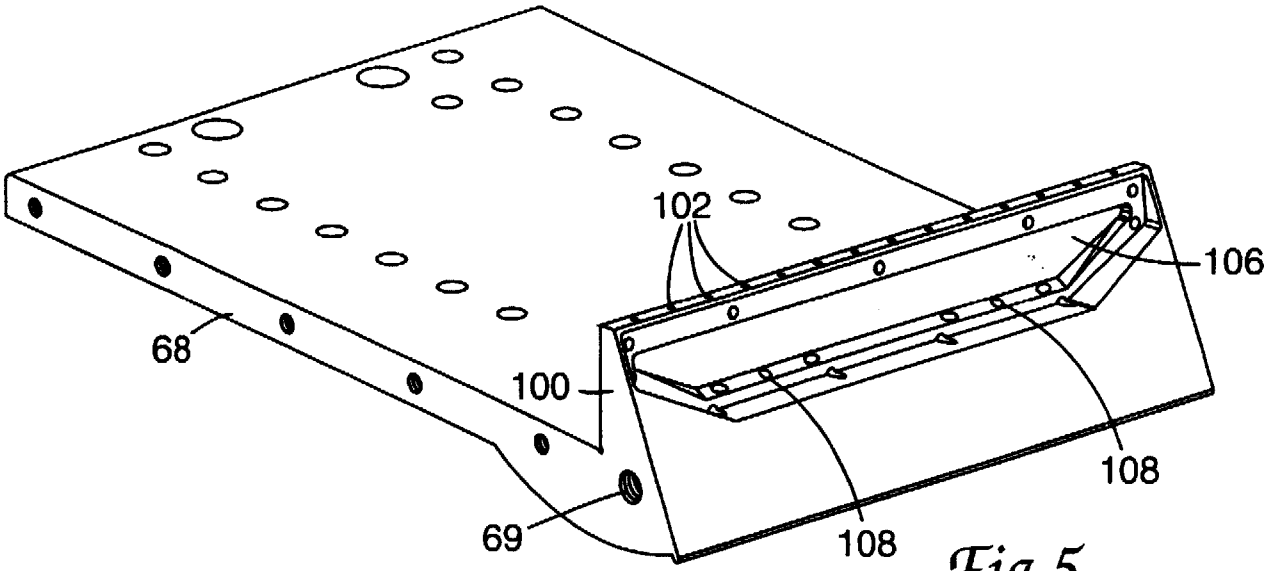
FIG. 5 is a perspective view of a spraying system for a coating die.

As best seen in FIGS. 3 and 5, the coating tray 68 has a front edge 100 with a plurality of spraying holes 102 positioned to spray cleaning fluid onto a front face 104 of the coating bar 62. A manifold area 106 is formed in the front edge 100 of the coating tray 68 immediately below the holes 102. The manifold cover 110 (see FIG. 3) is provided for sealing the manifold area 106. The cleaning fluid is supplied to the coating tray 68 through ports 71. The coating tray 68 is temperature stabilized by coolant circulated through ports 69.

In the embodiment illustrated in FIG. 5, the front edge 100 has 14 holes 102 separated by 12.7 mm (0.5 inches) and having a diameter of 0.56 mm (0.022 inches). It is understood that the present die edge cleaning system 52 may be configured as an arrangement of holes, slots, atomizers, spray nozzles, and a variety of other configurations without departing from the scope of the present invention. A cleaning fluid is introduced into the manifold area 106 through a series of holes 108. The holes 108 preferably have a diameter of 3.175 mm (0.125 inches).

Figure 1:
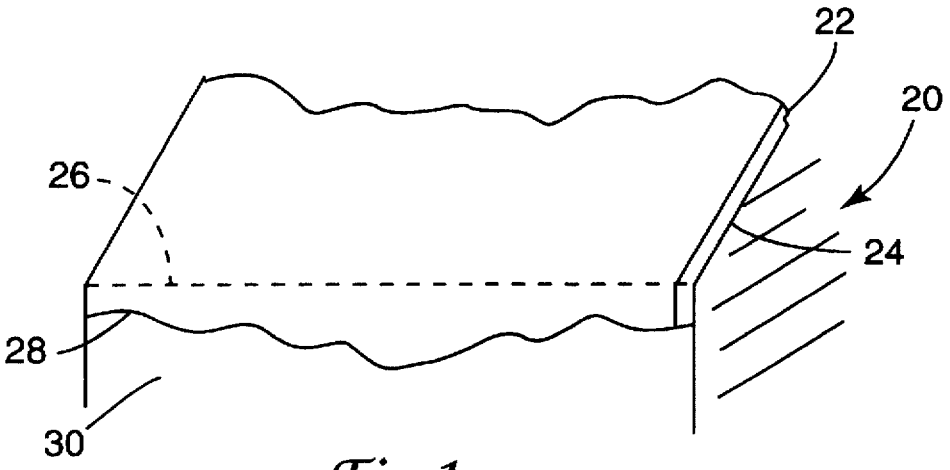
Fig.1 (Prior Art)
FIG. 1 is a schematic illustration of a static wetting line in a prior slide coating die.
Figure 4:
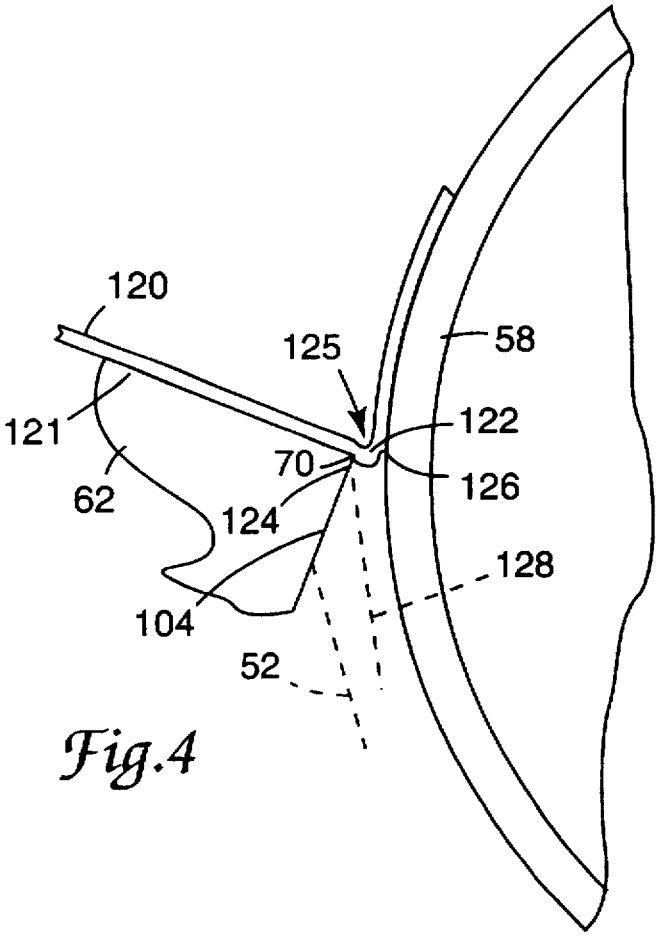
FIG. 4 is a schematic illustration of the interface of the slide coating die with the moving web.

FIG. 4 is a schematic illustration of the interface between a coating fluid 120 traversing a top surface 121 of the coating bar 62 past the moving web 58. When the slide coater assembly 50 is moved into the coating position for pick-up, the flow of cleaning fluid from the holes 102 (see FIG. 5) is increased to a high flow rate. As the cleaning fluid exits from the holes 102, the front face 104 is washed clean. The spray region 128 of the die edge cleaning system 52 preferably extends to the die edge 70. Alternatively, the spraying region 128 may include a portion of the front face 104 between about 1 mm and 20 mm below the die edge 70. A high flow rate of cleaning fluid is maintained for several seconds until any residue in the vicinity of the die edge 70 is removed. Applicants have found that a flow rate of about 50 $cm^3$ /min. per 25.4 mm of die edge length for a period of 5 to 10 seconds adequately cleans the front face 104 prior to formation of the coating bead 122. In an alternate embodiment, the spraying system 52 may be configured such that the high flow rate does not disrupt the coating bead 122, such that the high flow rate may be maintained during the coating process.

The front face 104 illustrated in FIG. 4 may include a durable, low surface energy portion. These portions are intended to provide the desired surface energy properties to specific locations to uniformly pin the coating fluid to prevent build-up of dried material. Details regarding the process of making such durable, low surface energy portions are disclosed in commonly assigned U.S. patent application serial No. 08/659,053 filed May 31, 1996.

During the high flow rate, the cleaning fluid disturbs the coating bead 122. After the front face 104 is cleaned, the flow rate is then reduced or eliminated so that a stable coating bead 122 is formed in the coating gap 125 between the die edge 70 and the moving web 58. The coating gap 125 is typically between 0.0254 mm and 3.81 mm. The coating bead 122 has a static wetting line 124 along the front face 104 and a dynamic wetting line 126 on the moving web 58. The pressure just under the lower meniscus is below atmospheric pressure.

The method of the present invention involves spraying the front face 104 of the coating bar 62 to remove any contamination thereon. Since this spraying action occurs in the vicinity of the die edge 70, the coating bead 122 is temporarily disrupted. After the front face 104 is adequately cleaned, the flow rate of the die edge cleaning system 52 is reduced or eliminated so that the coating bead 122 can reform. In the preferred embodiment, the flow rate of the cleaning fluid from the die edge cleaning system 52 is reduced during the coating process so as to not interfere with the coating bead 122. The low flow rate continuously wets the internal surfaces of the vacuum box 80 and slows drying of the coating fluid. Any contamination formed in the vacuum box 80 is more easily washed down the drain 90. Moreover, the low flow rate prevents the holes 102 from becoming contaminated when the coating process has been interrupted and the coating fluid is falling into the vacuum box 80. The continuous supply of cleaning fluid may also partially saturate the atmosphere with a solvent vapor within the vacuum box 80, which can reduce drying at the wetting line of the coating gap 125 of the coating bead 122. A method of vapor saturation to stop drying of a coating bead is described in commonly assigned U.S. patent application Ser. No. 08/177,288 filed Jan. 4, 1994.

When the slide coater assembly 50 is retracted from the web 58, the coating fluid 120 flows into the vacuum box 80 and into the drain 90. The low flow rate of cleaning fluid from the die edge cleaning system 52 is preferably maintained when the slide coater assembly is in the retracted position. Use of a low flow rate of cleaning fluid from the die edge cleaning system 52 is particularly important with high viscosity coating fluids (100–10,000 cP).

The cleaning fluid serves a variety of purposes, including without limit pre-wetting critical surfaces of the coating system, preventing premature drying of the coating fluid, providing a solvent vapor pressure to retard drying of the coating fluid, washing-off surfaces of the coating die to remove debris, and cleaning the vacuum box and vacuum ports. In the preferred embodiment, the cleaning fluid ejected from the die edge cleaning system 52 is a solvent of the coating fluid 120, such as methyl ethyl ketone, tetrahydrofuran, and methanol. It is understood that for aqueous coating fluids, the cleaning fluid may simply be water.

Figure 6:
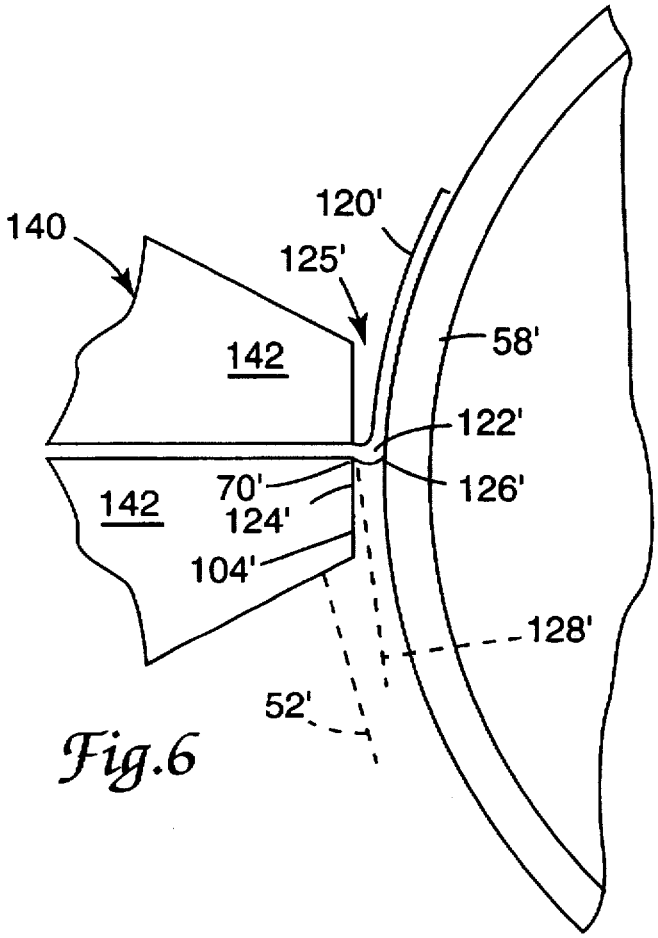
FIG. 6 is a schematic illustration of a slot or extrusion die utilizing the present spraying system.

FIG. 6 is a schematic illustration of a slot or extrusion coater 140 for coating a coating fluid 120' onto a moving web 58'. When the extrusion coater 140 is moved into the coating position for pick-up, the flow of cleaning fluid from the spraying system 52' is increased to a high flow rate. The cleaning fluid cleans the face 104' of the extrusion die 142. A high flow rate of cleaning fluid is maintained for several seconds until any residue in the vicinity of the die edge 70' is removed. The flow rate is then reduced or eliminated so that a coating bead 122' is formed in the coating gap 125' between the die edge 70' and the moving web 58'. The coating gap 125' is typically between 0.0254 mm and 3.81 mm. A coating bead 122' consists of a static wetting line 124' along the front face 104' in a dynamic wetting line 126' on the moving web 58'. The spray region 128' of the die edge cleaning system 52' preferably extends to the top of the die edge 70'. Alternatively, the spraying region 128' may include a portion of the front face 104' between about 1 mm and 20 mm below the die edge 70'.

Figure 7:
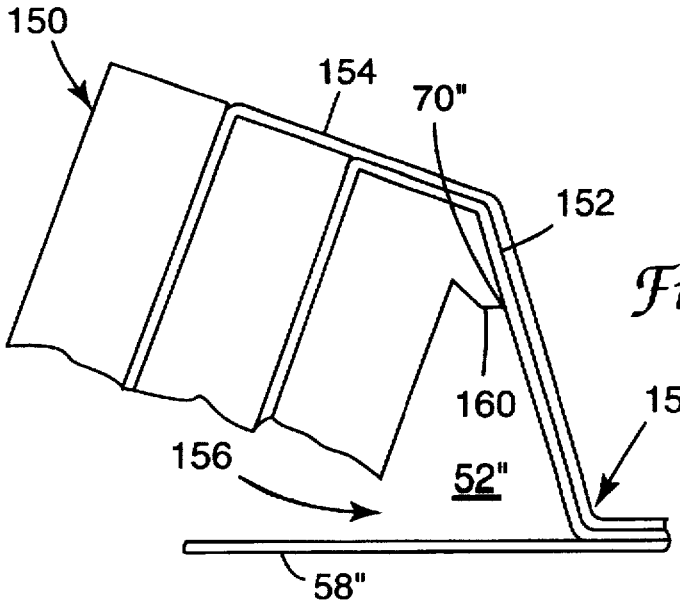
FIG. 7 is a schematic illustration of a curtain coating die utilizing the present spraying system.

FIG. 7 is a schematic illustration of a curtain coater 150 for coating a multi-layer, coating fluid 152, 154 onto a moving web 58". The main advantage of the curtain coater 150 is the large coating gap 156 that allows splices in the web 58" to pass without retracting the curtain coater 150. Since the momentum of the falling curtain of coating fluid 152, 154 helps hold the coating bead against the web 58", curtain coating may be carried out at higher coating speeds.

After the flow of the coating fluids 152, 154 are initiated, the flow of cleaning fluid from the spraying system 52" is increased to a high flow rate. The cleaning fluid cleans the face 160 of the curtain coater 150. A high flow rate of cleaning fluid is maintained for several seconds until any residue in the vicinity of the die edge 70" is removed. The flow rate is then reduced or eliminated so that a stable coating bead 158 is formed at the interface with the moving web 58". The coating gap 156 is typically between 10 mm and 150 mm.

Any coated material, such as graphic arts materials, non-imaging materials such as adhesives and magnetic recording media, and imaging materials such as photographic, photothermographic, thermographic, photoresists and photopolymers, can be coated using the method and apparatus of the present invention. Materials particularly suited for coating using the present method and apparatus include photothermographic imaging constructions (e.g., silver halide-containing photographic articles which are developed with heat rather than with a processing liquid). Photothermographic constructions or articles are also known as "dry silver" compositions or emulsions and generally comprise a substrate or support (such as paper, plastics, metals, glass, and the like) having coated thereon: (a) a photosensitive compound that generates silver atoms when irradiated; (b) a non-photosensitive, reducible silver source; (c) a reducing agent (i.e., a developer) for silver ion, for example for the silver ion in the non-photosensitive, reducible silver source; and (d) a binder.

Thermographic imaging constructions (i.e., heat-developable articles) can also be coated using the method and apparatus of the present invention. These articles generally comprise a substrate (such as paper, plastics, metals, glass, and the like) having coated thereon: (a) a thermally-sensitive, reducible silver source; (b) a reducing agent for the thermally-sensitive, reducible silver source (i.e., a developer); and (c) a binder.

Photothermographic, thermographic, and photographic emulsions used in the present invention can be coated on a wide variety of substrates. The substrate (also known as a web or support) 58 can be selected from a wide range of materials depending on the imaging requirement. Substrates may be transparent, translucent, or opaque. Typical substrates include polyester film (e.g., polyethylene terephthalate or polyethylene naphthalate), cellulose acetate film, cellulose ester film, polyvinyl acetal film, polyolefinic film (e.g., polyethylene or polypropylene or blends thereof), polycarbonate film, and related or resinous materials, as well as aluminum, glass, paper, and the like.

EXAMPLE

The following example was performed on a slide coater to confirm the benefits provided by the configuration and method for using the slide coater assembly 50 with the die edge cleaner system 52 of FIGS. 2 and 3. All materials used in the following example are readily available from standard commercial sources, such as Aldrich Chemical Co. Milwaukee, Wis., unless otherwise specified. All percentages are by weight unless otherwise indicated. The following additional terms and materials were used.

Butvar™ B-79 is a polyvinyl butyral resin available from Monsanto Company, St. Louis, Mo.

MEK is methyl ethyl ketone (2-butanone).

MeOH is methanol.

Vitel™ PE 2200 is a polyester resin available from Shell; Houston, Tex.

A four layer coating is prepared using the preferred slide set-up described in FIGS. 2 and 3, and shown below in Table A1. The slide angle α is 25° relative to horizontal and the position angle β of a line connecting the die edge to the back-up roll center relative to horizontal is −7°. In order to observe the coating, an optically clear, glass back-up roll and a clear 0.051 mm (2 mil) polyester web substrate were used.

The first two layers (i.e., the bottom most layers) $V_1$ and $V_2$ comprise an adhesion promoting layer. Layer $V_1$ is a solution of Vitel™ PE2200 resin in MEK at 14.7% solids. Layer $V_2$ is also a solution of Vitel™ PE2200 resin in MEK, but at 30.5% solids. Layer $V_2$ is completely miscible with Layer $V_1$.

TABLE A1

| Layer | Slot Height mm (mil) | Slot Step mm (mil) | Slide Angle α | Position Angle β |
|---|---|---|---|---|
| $V_1$ | 0.127 (5) | 0 | 25 | −7 |
| $V_2$ | 0.127 (5) | 0 | | |
| $V_3$ | 0.508 (20) | 1.524 (60) | | |
| $V_4$ | 0.381 (15) | 1.524 (60) | | |

The third layer $V_3$ is a representative photothermographic emulsion layer. It is prepared as described below in Table A2. This emulsion layer does not contain developers, stabilizers, antifoggants, etc. but is otherwise identical to photothermographic emulsion layers used in producing photothermographic imaging materials. The silver homogenate was prepared as described in U.S. Pat. Nos. 5,382,504 and 5,434,043 and contained 20.8% pre-formed silver soap and 2.2% Butvar B-79 resin.

TABLE A2

Composition of Photothermographic Emulsion Layer $V_3$

| Premix | Chemical Name | Wt. % |
|---|---|---|
| A | Silver Homogenate | 69.52 |
| B | Methanol | 4.21 |
| C | MEK | 9.72 |
| D | Butvar ™ B-79 | 16.55 |

The fourth layer $V_4$ is a topcoat layer and is prepared substantially as described in U.S. Pat. No. 5,541,054. The solution properties for the four coating layers are shown below in Table A3. The reported value of viscosity is as measured by a Brookfield viscometer, at shear rate of approximately 1.0 $s^{-1}$, and the density is from a % solids vs. density curve for each of the layer formulations.

TABLE A3

| Layer | % solids | Viscosity, cP | Density, g/cm³ | Wet Thickness W, μm |
|---|---|---|---|---|
| $V_1$ | 14.7 | 12 | 0.85 | 5.0 |
| $V_2$ | 30.5 | 144 | 0.91 | 17.0 |
| $V_3$ | 31.7 | 1086 | 0.92 | 71.7 |
| $V_4$ | 14.6 | 1300 | 0.86 | 19.3 |

The predominant solvent in the coating layers is MEK and it is also the cleaning fluid. Details of the spray system and vacuum box are detailed in Table A4. The solvent spray is started at the low volume flow rate. The spray flow is directed to the front face of the slide coating bar at a region about 12.7 mm (0.5 inches) below the die edge. Next, coating liquid flows $V_1$, $V_2$, $V_3$ and $V_4$ are established for the coating web speed of 30.5 meters/min (100 ft/min) with the slide die assembly retracted from the back-up roll and web. The coating die is moved into the coating position with a 0.254 mm (10 mil) coating gap between the die edge and the moving web in order to pickup coating. The spray flow is increased to the high volume spray flow rate for approximately 10 seconds and then reduced to the low volume flow rate for the duration of normal coating. Using the optically clear, glass back-up roll and coating on a clear 0.051 mm (2 mil) polyester web as the substrate, a straight wetting line on the die lip and streak free coating is observed. During normal coating, the vacuum box and drain tubes are observed to clean by the flow of the cleaning fluid at the low volume flow rate.

TABLE A4

| Item | Description/Value |
|---|---|
| Spray and Vaccuum Box Design | As shown in FIGS. 2, 3, and 5 |
| Spray Holes: | 0.56 mm (0.22 inch) diameter, every 12.7 mm (0.5 inch), 14 total |
| Solvent Spray Pump: | 2.92 cm³/rev Zenith metering pump |
| Cleaning Fluid: | MEK |
| Low Volume Flow Rate Solvent Spray Calculation: | 3 RPM or 8.76 cm³/min (1.46 cm³/inch per min) |
| High Volume Spray Flow Rate Solvent Spray Calculation: | 100 RPM or 292 cm³/min (48.67 cm³/inch per min) |
| Coating Vaccuum: | 99.6 Pa (0.4 inch water column) |
| Vaccuum Supply Orifice: | 7.93 mm (0.312 inch) I. D. |
| Vaccuum Manometer Orifice: | 5.08 mm (0.20 inch) entry diameter |
| Vaccuum Box Drain Hose: | 38.1 mm (1.5 inch) I. D. Tubing |
| Coating Width: | 15.24 cm (6 inch) |

All patents and patent applications cited above are hereby incorporated by reference. The present invention has now been described with reference to several embodiments described herein. It will be apparent to those skilled in the art that many changes can be made in the embodiments without departing from the scope of the invention. Thus, the scope of the present invention should not be limited to the structures described herein, but only to structures described by the language of the claims and the equivalents to those structures.

What is claimed is:

1. A method for applying a coating fluid to a moving web comprising the steps of:

extruding the coating fluid through at least one feed slot of a coating die, the coating die having a front face demarked from the at least one feed slot by a die edge;

positioning a moving web and the coating die such that a coating bead is formed in a gap between the moving web and the die edge to initiate coating of the coating fluid onto the moving web;

spraying a cleaning fluid at a first flow rate on at least a portion of the front face of the coating die for an initial period;

terminating the first flow rate such that a coating bead with a generally linear static wetting line is formed on the front face during coating of the coating fluid onto the moving web; and optionally spraying cleaning fluid at a second flow rate.

2. The method of claim 1 wherein the second flow rate comprises a flow rate of zero.

3. The method of claim 1 wherein the second flow rate comprises substantially the same flow rate as the first flow rate.

4. The method of claim 1 wherein the second flow rate is less than the first flow rate.

5. The method of claim 1 further comprising the step of generating a reduced pressure condition below the coating bead and between the front face and the moving web.

6. The method of claim 1 wherein the step of spraying a cleaning fluid comprises spraying a solvent of the coating fluid.

7. The method of claim 1 wherein the step of spraying comprises directing the cleaning fluid to a portion of the front surface about 1 mm to 20 mm below the die edge.

8. The method of claim 1 wherein the step of spraying a cleaning fluid comprises spraying the cleaning fluid on a portion of the front face below the die edge so that at least a portion of the coating bead is formed on the front face of the slide coating die.

9. The method of claim 1 wherein the static wetting line comprises a wetting line generally perpendicular to a first direction of the moving web.

10. The method of claim 1 wherein the coating die comprises an extrusion die.

11. A method for applying a coating fluid to a moving web comprising the steps of:

extruding the coating fluid through at least one feed slot of a coating die, the coating die having a front face demarked from the at least one feed slot by a die edge;

positioning a moving web and the coating die such that a coating bead is formed in a gap between the moving web and the die edge to initiate coating of the coating fluid onto the moving web;

spraying a cleaning fluid at a first flow rate on at least a portion of the front face of the coating die for an initial period; and terminating the first flow rate such that a coating bead with a generally linear static wetting line is formed on the front face during coating of the coating fluid onto the moving web.

12. A method for applying a coating fluid to a moving web comprising the steps of:

extruding the coating fluid through at least one feed slot of a coating die, the coating die having a front face demarked from the at least one feed slot by a die edge;

positioning a moving web and the coating die such that a coating bead is formed in a gap between the moving web and the die edge to initiate coating of the coating fluid onto the moving web;

spraying a cleaning liquid at a first flow rate on at least a portion of the front face of the coating die for an initial period;

terminating the first flow rate such that a coating bead with a generally linear static wetting line is formed on the front face during coating of the coating fluid onto the moving web; and optionally spraying cleaning liquid at a second flow rate.

* * * * *